US005917420A

United States Patent [19]

Gonzalez

[11] Patent Number: 5,917,420

[45] Date of Patent: Jun. 29, 1999

[54] SMOKE/FIRE DETECTOR FOR THE HEARING IMPAIRED

[76] Inventor: Antonio Gonzalez, 36 Buttenwood Rd., Stratford, N.J. 08084

[21] Appl. No.: 08/789,262

[22] Filed: Jan. 28, 1997

[51] Int. Cl.[6] ..... G08B 3/00

[52] U.S. Cl. ..... 340/691.7; 340/407.1; 340/541; 340/573.1; 340/577; 340/584; 340/628; 340/632; 340/693.9

[58] Field of Search ..... 340/407.1, 541, 340/542, 544, 545, 550–552, 561, 565, 573.1, 577–579, 584, 628–630, 632, 683, 691.7, 693.9, 825.46; 74/53, 125, 567, 569, 838

[56] References Cited

U.S. PATENT DOCUMENTS

| | | | |
|---|---|---|---|
| 256,265 | 4/1882 | Applegate . | |
| 516,614 | 3/1894 | Seaman . | |
| 804,653 | 11/1905 | Garris . | |
| 1,046,533 | 12/1912 | Zukor . | |
| 1,215,666 | 2/1917 | Leal . | |
| 1,366,983 | 2/1921 | Waller . | |
| 3,618,070 | 11/1971 | Kagan | 340/407.1 |
| 3,786,628 | 1/1974 | Fossard et al. | 340/407.1 |
| 4,093,944 | 6/1978 | Muncheryan | 340/407.1 |
| 4,178,592 | 12/1979 | McKee | 340/628 |
| 4,553,138 | 11/1985 | Nakanishi et al. | 340/407.1 |
| 4,794,392 | 12/1988 | Selinko | 340/825.46 |
| 5,076,260 | 12/1991 | Komatsu | 128/33 |
| 5,686,884 | 11/1997 | Larkin et al. | 340/407.1 |

*Primary Examiner*—Daniel J. Wu
*Attorney, Agent, or Firm*—Caesar, Rivise, Bernstein, Cohen & Pokotilow, Ltd.

[57] ABSTRACT

An alarm apparatus for shaking a piece of furniture in response to detection of a physical occurrence, such as smoke, fire, $CO_2$, or even a burglar, is provided. The apparatus includes a detector for detecting the physical occurrence and emitting a signal in response thereto. Connected to the detector is a signalling device that is positioned adjacent the piece of furniture to be shaken in response to the signal emitted from the detector. The signalling device includes a rotating cam shaft with a cam member thereon, against which is positioned one end of a cam follower. The opposite end of the cam follower is directed toward the piece of furniture, so that movement of the follower over the cam as the cam shaft rotates causes the furniture to move up and down.

11 Claims, 2 Drawing Sheets

302
332
335
336
306
337
305
3
3
328
308
334
330
312
210
354
300
10
POWER SOURCE
356
352
350
324
310
POWER RELAY
200
100
212
POWER CHARGING SOURCE 340
336
337
316
314
320
318
312
310
326
302
305

SMOKE/FIRE DETECTOR FOR THE HEARING IMPAIRED

FIELD OF THE INVENTION

This invention relates to a fire detection device and alarm, and more particularly relates to an alarm that will arouse sound sleepers or hearing impaired individuals in the event of a fire emergency.

BACKGROUND OF THE INVENTION

The importance of smoke and fire detectors in homes has been recognized for many years, especially audible detectors that warn occupants of the danger of fire by emitting a loud warning signal upon detecting the presence of smoke or heat. While considerable attention has been paid to developing detection and warning devices that emit an audible warning signal, there appears to have been very little consideration given to warning devices especially adapted to the unique needs of the hearing impaired or deaf individuals. Likewise, little or no attention has been paid to the very sound sleeper who may not be easily awakened by even a loud warning signal.

As early as 1894, devices were developed to awaken sound sleepers by more than just an audible signal. For example, U.S. Pat. No. 516,614 discloses an alarm that causes the bottom of the bed to pivot downward and thus awaken the sleeping occupant of the bed. An even earlier patent, U.S. Pat. No. 256,265 discloses an alarm device that awakens sleepers by, apparently releasing suspended devices onto the sleeper in response to an alarm clock ringing. In 1905, U.S. Pat. No. 804,653 taught still another type of alarm device to awaken a sound sleeper. This device was designed to attach to the arm of the sleeper and awaken the sleeper by shaking the sleeper's arm. A burglar alarm is disclosed in U.S. Pat. No. 1,046,533 that arouses a sleeping person upon the entry of an intruder by releasing a spray of water onto the sleeper when a door or window is opened, and U.S. Pat. No. 1,215,666 discloses an alarm device that awakens a sleeper by forcibly causing the body of the sleeper to raise to an upright sitting position.

More recently, U.S. Pat. No. 5,076,260 presented a device that among other features awakens a sleeper on a water bed in cases of an emergency by means of vibrations generated by low frequency sound vibrations.

While all of these devices are probably effective, and are certainly in some instance very humorous, they are not very practical for easy use by a significant number of people. What is needed is a simple, cost effective device that can be readily adapted for use on a large scale by those people who are hearing impaired or sound sleepers.

OBJECTS OF THE INVENTION

With the above background in mind, it is a primary object of the present invention to provide an alarm device that is responsive to a signal generated by a detection device, for example, smoke or fire detectors, a $CO_2$ detector or even a burglar alarm, and which will awaken and warn a hearing impaired individual who would not otherwise realize that an audible warning is being sounded.

It is also an object of the invention to provide a device that will shake or vibrate a bed frame or other furniture in response to receiving a signal from a smoke or fire detector in order to arouse and warn the hearing impaired or heavy sleeper.

It is a further object of the invention to provide a device that is easy to install and operate and is economical to construct.

It is an additional object of the invention to provide a device that can be easily positioned directly onto a hard surface floor or, alternatively, securely positioned on a carpet beneath a bed frame or other piece of furniture.

It is yet a further object of the invention to provide an alarm device that is adjustable for use with bed frames or other furniture of different heights.

SUMMARY OF THE INVENTION

In furtherance of the above objects, the detection and alarm apparatus of the present invention operates on the simple principle of a detection device, operatively connected to a device that shakes a bed in which the hearing impaired person might be sleeping or the chair or other furniture that the person may be resting upon. The detection device may be, for example, a standard smoke detector or fire detector, or possibly a $CO_2$ detector or burglar alarm, that would normally produce a auditory signal in response to detecting the presence of smoke, fire, $CO_2$ or a burglar. In this instance the signal generated upon detection is used to energize an electric motor that in turn causes the bed or furniture to shake. The shaking of the bed or furniture is effectuated by means of a plunger member that rides against a rotating camming member that is caused to rotate when the electric motor is energized. By riding against the camming member, the plunger raises and lowers as the cam shaft rotates. The end to the plunger member opposite the camming member is positioned against the underside of a bed frame or other piece of furniture, so that as the plunger member moves up and down in response to riding over the camming member on the cam shaft, the bed or furniture is shaken and the occupant is alerted to the detected condition.

The device is further provided with an electric relay between the detecting device and the electric motor that causes the cam shaft to rotate. The electric relay is preferably connected to a battery power source, but a standard electrical outlet might also be provided for. In the event of a power failure, the battery power supply will engage to energize the motor. It is further envisioned that the battery backup will be a rechargeable battery that is constantly charged.

BRIEF DESCRIPTION OF THE DRAWINGS

Other objects and many of the attendant advantages of the present invention will be readily appreciated as the same become better understood by reference to the following detailed description when considered in conjunction with the accompanying drawings, wherein.

DETAILED DESCRIPTION OF THE PREFERRED EMBODIMENT

Figure 1:
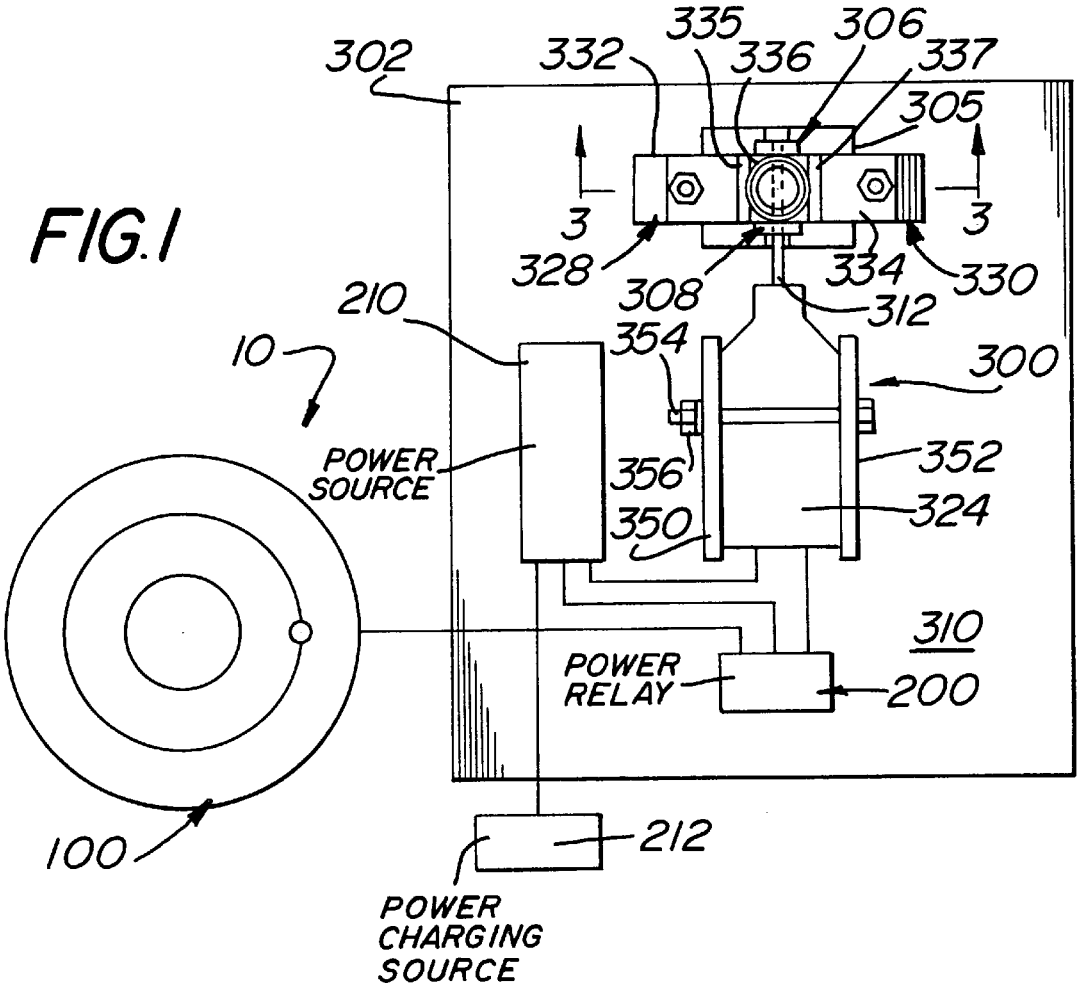
FIG. 1 is a schematic top view of the signalling device of the present invention.
Figure 2:
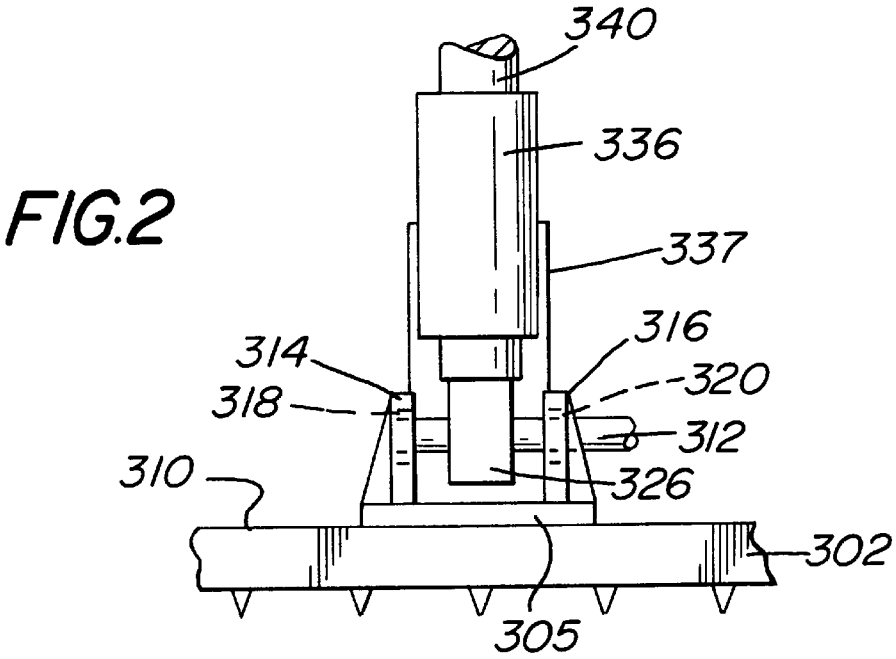
FIG. 2 is a section view taken along the line 202 in FIG. 3.

Referring now in greater detail to the figures of the drawings wherein like reference characters refer to like parts, the smoke/fire detector of the present invention is shown diagrammatically at 10 in FIG. 1.

As can be seen schematically in FIG. 1, the device of the present invention includes a detector apparatus 100, which is of known design and construction. This detector may be a smoke or fire detector, or even a $CO_2$ detector or burglar alarm. For case of discussion, reference will be made only to a smoke/fire detector. The smoke/fire detector apparatus is connected to a power relay switch 200 that is also connected to a power source 210 and the motor 324 of the signalling device 300. Upon receiving a signal from the smoke/fire detector 100, the power relay switches on the signalling device 300. The power relay switch 200 is preferably connected to a self-contained power source, e.g., a battery pack 210. Although it is within the knowledge of one skilled in the art to a provide a power source that is a regular electrical outlet, in the preferred embodiment, the battery pack is rechargeable and is connected to a charging power source 212. If there should be a power failure, the battery pack, by remaining constantly charged, will alway s provide a source of power to operate the signalling device 300. The detector apparatus 100 may be either battery-operated or directly wired to an electrical power source. The detector apparatus is preferably mounted in the most effective position for detecting smoke or fire, usually on a wall or ceiling.

Figure 3:
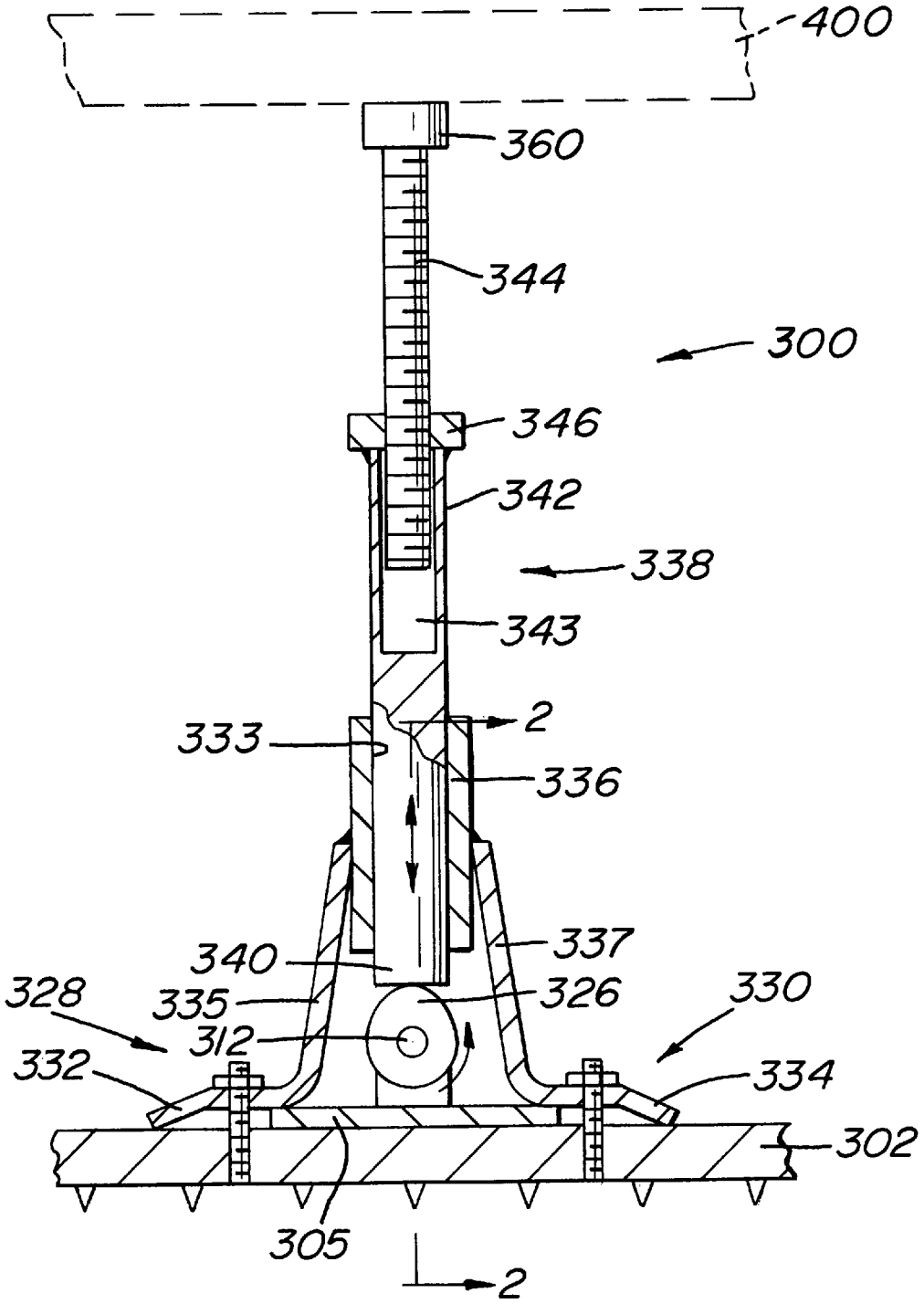
FIG. 3 is a partial section view of the signalling device of the present invention taken generally along line 3—3 in FIG. 1.

The unique signalling device 300 of the present invention is shown in more detail in FIG. 3. The signalling device includes a base member 302 designed to rest on a hard surface, e.g., the floor, or on a soft surface, e.g., a carpet. If the base member 302 is to rest upon a carpeted surface, it may have projections 304 on the underside thereof in order to more securely hold the base member 302 on a carpeted surface so that it does not move about. For a hard finish surface, such as a non-carpeted floor, these projections 304 can be eliminated. The projections may also be designed to be retractable so that the device can be used selectively on either a hard or carpeted surface.

Two shaft brackets 306, 308 are spaced from each other on a plate 305 mounted on the upper surface 310 of the base member 302. The shaft brackets 306, 308 guide therebetween in a rotatable fashion a cam shaft 312. In particular, the shaft brackets include vertical support members 314, 316 with circular openings 318, 320 through each support member 314, 316, respectively. The circular openings 318, 320 have an inside diameter sufficient to allow free rotation of the cam shaft 312 mounted therein.

The cam shaft 312 extends through the opening 320 and is connected to an electric motor 324 that is operated by the battery pack power supply 210. Engaging the motor 324 causes the cam shaft 312 to rotate within the circular openings 318, 320. The electric motor 324 is positioned on the base member 302 between two vertical braces 350, 352. A bolt 354 passing through the vertical braces above the motor 324 and secured there by means of a nut 356 further helps to keep the motor in place on the platform.

Along the length of the cam shaft 312, so as to be positioned between the two circular openings is a cam member 326 that projects radially outwardly from the axis of rotation of the cam shaft.

As shown in FIG. 3, opposite each other across the axis of rotation of the cam shaft are two substantially L-shaped support brackets 328, 330. These support brackets 328, 330 are affixed at their horizontal base ends 332, 334, respectively, to the base member 302 and their vertical portions project substantially vertically upwardly away from the base ends. The base ends may be screwed, bolted or otherwise secured to the base member 302 in any suitable manner known in the art. As shown in FIG. 3, the base ends 332, 334 are bolted onto the base member 302. Fitted between the vertical portions 335, 337 of the support brackets and above the cam member 326 is a housing member 336, preferably a cylindrical housing with an opening 333 therethrough.

Within the opening 333 in the housing member 336 is a cam follower 338. The cam follower is free to move vertically within the opening. The bottom end 340 of the follower rests upon the outside surface of the cam shaft 312 and is positioned to contact the cam member 326 as the cam shaft rotates within the circular openings 318, 320.

The cam follower 338 includes a plunger member 342 and an externally threaded adjuster member 344 positioned within an opening 343 in the plunger 342. Threaded onto the adjuster member 344 is a nut 346. By threading and positioning the nut 346 on the adjuster member 344 and allowing the nut to rest upon the top of the plunger member, the length of the adjuster member 344 extending above the plunger 342 and out of the opening 343 can be adjusted and, thus, the overall length of the cam follower 338 can be varied according to the height of the object to be contacted by the cam follower.

The signalling device 300 is positioned underneath, for example, a bed frame 400 (as shown in phantom line in FIG. 3.). The length of the cam follower 338 is adjusted by turning the adjuster nut 346 on the outside of the adjuster member 344 so that the adjuster member is located within the opening 343 in the plunger and the top end 360 of the adjuster member urges against the bed frame 400 (shown in phantom lines in FIG. 3), when the bottom of the plunger 342 is resting on the outer surface of the cam shaft 312, and not the surface of the cam member 326 (FIG. 3).

The device of the present invention warns deaf, hearing impaired, or heavy sleepers by shaking the bed, or other piece of furniture, with which it is associated. This is accomplished in the following manner. With the device 10 positioned underneath a bed frame and with the adjuster member 344 preferably snugly adjusted against the underside of the bed frame by positioning the nut 346 on the adjuster member 344, the device is ready to operate upon a signal from the detector 100. When, for example, smoke or fire is detected, the smoke/fire detector 100 signals the power relay switch 200 to engage the electric motor 324 by directing current from the battery power supply 210 to the motor, which, in turn, causes the cam shaft 312 connected to the motor 324 to rotate. As the cam shaft rotates, the plunger 342 follows the surface of the cam shaft 312 and rides against the surface of the cam member 326, thereby causing the cam follower 338 to move up and down and the bed frame to move up and down. With repeated rotations of the motor, the bed is caused to move up and down, i.e., shake, and the occupant of the bed is awakened, even though the occupant does not discern the audible signal from the detector.

Without further elaboration, it is believed that the foregoing so fully illustrates the present invention that others may, by applying current or future knowledge, apply the same for use under various conditions of service.

I claim:

1. An alarm apparatus for shaking a piece of furniture in response to detection of a physical occurrence, said apparatus comprising:

detecting means for detecting a physical occurrence and emitting a signal in response thereto; and signalling means connected to said detecting means for receiving a signal emitted therefrom and positioned adjacent the piece of furniture for shaking the piece of furniture in response to a signal emitted from said detecting means, said signalling means being comprised of:

motor means adapted to be connected to a power source and said detecting means;

a cam shaft extending from and rotated by said motor means said cam shaft having an outer surface and an axis of rotation;

a cam member on said outer surface of said cam shaft extending radially outwardly from said axis of rotation; and follower means having first and second ends and contacting said cam member at said first end thereof and extending from said cam shaft in a direction transverse to said axis of rotation of said cam shaft and positioned to contact said cam member when said cam shaft rotates for contacting and shaking the piece of furniture at said second end in response to rotation of said cam shaft and said cam member.

2. An alarm apparatus as claimed in claim 1, wherein said detecting means is comprised of at least one detector selected from the group of detectors consisting of smoke detectors, heat detectors, $CO_2$ detectors, and burglar alarms.

3. An alarm apparatus as claimed in claim 1, wherein said motor means is comprised of:

a motor; and relay means adapted to be connected to a power source, to said detecting means and to said motor means for directing power from the power source to said motor upon receipt of the signal emitted by said detecting means, whereby said motor is caused to operate in response to the signal emitted from said detecting means.

4. An alarm apparatus as claimed in claim 1, wherein said motor means is further comprised of:

an electric motor;

a battery power source for operating said motor;

relay means connected to said detecting means, said motor and to said battery power source for directing electric power from said battery power source to said motor upon receipt by said relay means of the signal emitted by said detecting means, whereby said motor is caused to operate and said cam shaft to rotate in response to the signal emitted from said detecting means.

5. An alarm apparatus as claimed in claim 4, wherein said battery means is a rechargeable.

6. An alarm apparatus as claimed in claim 1, wherein said signalling means is further comprised of bracket means spaced from said motor means and having at least one opening therethrough for receiving said cam shaft extending from said motor means through said opening.

7. An alarm apparatus as claimed in claim 6, wherein said bracket means is comprised of a pair of spaced support members, each support member having a circular opening therethrough for receiving said cam shaft extending from said motor means.

8. An alarm apparatus as claimed in claim 1, wherein said follower means is comprised of:

a pair of spaced support brackets on opposite sides of said cam shaft and said cam member;

a hollow housing member fitted between said support brackets, said hollow housing member being spaced from said cam shaft and spaced from said cam member;

a cam follower within said hollow housing member and positioned to contact and follow said cam shaft and said cam member when said cam shaft is rotated by said motor means; and adjustable plunger means within and extending from said cam follower in the direction away from said cam shaft and said cam member for contacting the piece of furniture, said plunger means extending an adjustable distance from said cam follower.

9. An alarm apparatus as claimed in claim 1, further comprising base support means for supporting thereon at least said signalling means, said base support means having a top surface with said signalling means mounted thereon and a bottom surface.

10. An alarm apparatus as claimed in claim 9, further comprising at least one projection extending from said bottom surface for securing said base support means on a carpeted surface.

11. An alarm apparatus for shaking a piece of furniture in response to detection of a physical occurrence by a detection device, said apparatus comprising signalling means connected to said detection device and positioned adjacent the piece of furniture for shaking the piece of furniture in response to the signal emitted from said detection device, said signalling means being comprised of:

motor means adapted to be connected to a power source and said detection device a cam shaft extending from and rotated by said motor means said cam shaft having an outer surface and an axis of rotation;

a cam member on said outer surface of said cam shaft extending radially outwardly from said axis of rotation; and follower means having first and second ends and contacting said cam member at said first end thereof and extending from said cam shaft in a direction transverse to said axis of rotation of said cam shaft and positioned to contact said cam member when said cam shaft rotates for contacting and shaking the piece of furniture at said second end in response to rotation of said cam shaft and said cam member.

* * * * *